United States Patent [19]

Tanahashi et al.

[11] Patent Number: 4,840,147

[45] Date of Patent: Jun. 20, 1989

[54] COMBUSTION CHAMBER OF A TWO-STROKE ENGINE

[75] Inventors: Toshio Tanahashi, Susono; Norihiko Nakamura, Mishima; Hiroshi Noguchi, Gotenba; Kenichi Nomura, Susono; Toyokazu Baika, Susono; Masanobu Kanamaru, Susono; Tatsuo Kobayashi, Susono; Hideo Nagaosa, Susono; Kazuhiro Ito, Susono; Toshio Ito, Susono; Kouichi Nakae, Susono, all of Japan

[73] Assignee: Toyota Jidosha Kabushiki Kaisha, Japan

[21] Appl. No.: 215,420

[22] Filed: Jul. 5, 1988

[30] Foreign Application Priority Data

| | | | |
|---|---|---|---|
| Jul. 9, 1987 | [JP] | Japan | 62-169684 |
| Nov. 17, 1987 | [JP] | Japan | 62-288390 |
| Apr. 27, 1988 | [JP] | Japan | 63-102659 |

[51] Int. Cl.[4] ..... F02B 75/02

[52] U.S. Cl. ..... 123/65 VD; 123/193 H; 123/432

[58] Field of Search ..... 123/193 H, 432, 65 VD, 123/308

[56] References Cited

U.S. PATENT DOCUMENTS

| | | | |
|---|---|---|---|
| 3,993,037 | 11/1976 | Mukai et al. | 123/432 |
| 4,162,662 | 7/1979 | Melchior | 123/65 VD |
| 4,291,655 | 9/1981 | Yamakawa | 123/193 H |
| 4,732,117 | 3/1988 | Tanahashi et al. | 123/65 VD |
| 4,732,118 | 3/1988 | Tanahashi et al. | 123/65 VD |
| 4,781,154 | 11/1988 | Tanahashi et al. | 123/65 VD |

*Primary Examiner*—E. Rollins Cross

*Attorney, Agent, or Firm*—Oliff & Berridge

[57] ABSTRACT

A two-stroke engine having an intake valve and an exhaust valve which are arranged on the cylinder head. A masking wall is formed on the inner wall of the cylinder head to mask the valve opening between the valve seat and the peripheral portion of the intake valve, which is located on the exhaust valve side, for the entire time for which the intake valve is open.

22 Claims, 8 Drawing Sheets

COMBUSTION CHAMBER OF A TWO-STROKE ENGINE

BACKGROUND OF THE INVENTION

1. Field of the Invention

The present invention relates to a combustion chamber of a two-stroke engine.

2. Description of the Related Art

To obtain a good loop scavenging operation in the combustion chamber of a known two-stroke diesel engine, a masking wall is provided for masking the valve opening between the valve seat and the peripheral portion of the intake valve, which is located on the cylinder axis side, and at the same time, masking the valve opening between the valve seat and the peripheral portion of the exhaust valve, which is located on the cylinder axis side, when the valve lifts of the intake valve and the exhaust valve are small. The intake port and the exhaust port are arranged to extend upward in parallel to the cylinder axis (Japanese Unexamined Patent Publication No. 52-104613). In this two-stroke diesel engine, air flowing into the combustion chamber from the intake port flows toward the top face of the piston along the inner wall of the cylinder. Subsequently, the flow direction of the air on the top face of the piston is changed, and the air then made to flow toward the exhaust port along the inner wall of the cylinder, to thereby carry out a loop scavenging operation.

In this two-stroke diesel engine, however, when the vale lifts of the intake valve and the exhaust valve become large, the valve opening between the intake valve and the valve seat is open to the combustion chamber over the entire periphery of the intake valve, and the valve opening between the exhaust valve and the valve seat is open to the combustion chamber over the entire periphery of the exhaust valve. As a result, air flowing into the combustion chamber from the valve opening of the intake valve, which is located on the cylinder axis side, moves forward along the inner wall of the cylinder head and is then discharged into the exhaust port via the valve opening of the exhaust valve. Consequently, in this two-stroke diesel engine, since a part of air fed from the intake port must be used to ensure an effective loop scavenging operation, a problem occurs in the engine in that a good scavenging operation cannot be obtained.

SUMMARY OF THE INVENTION

An object of the present invention is to provide a two-stroke engine in which a good scavenging operation is obtained.

According to the present invention, there is provided a two-stroke engine comprising: an engine body including a cylinder head having an inner wall; a piston reciprocally movable in the engine body, the inner wall of the cylinder head and a top face of the piston defining a combustion chamber therebetween; at least one intake valve arranged on the inner wall of the cylinder head; at least one exhaust valve arranged on the inner wall of the cylinder head; masking means arranged between the intake valve and the exhaust valve to mask a valve opening formed between a valve seat and a peripheral portion of the intake valve, which is located on the exhaust valve side, throughout the entire time for which the intake valve is open.

The present invention may be more fully understood from the description of preferred embodiments of the invention set forth below, together with the accompanying drawings.

DESCRIPTION OF THE PREFERRED EMBODIMENTS

Figure 1:
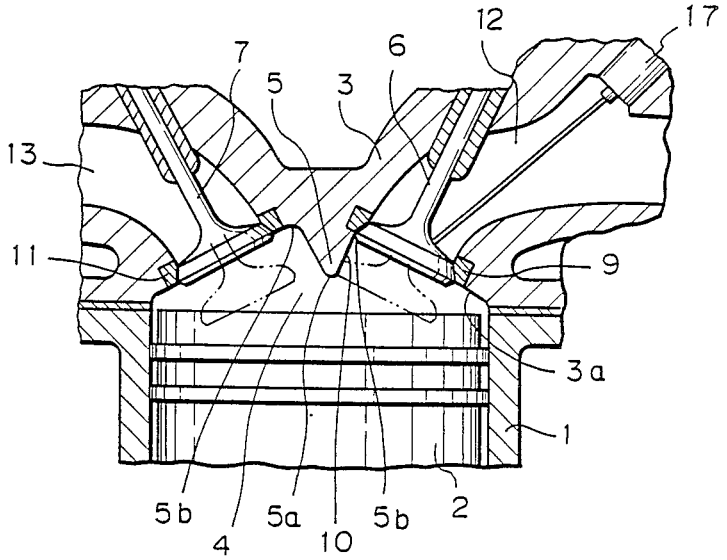
FIG. 1 is a cross-sectional side view of a two-stroke engine.
Figure 2:
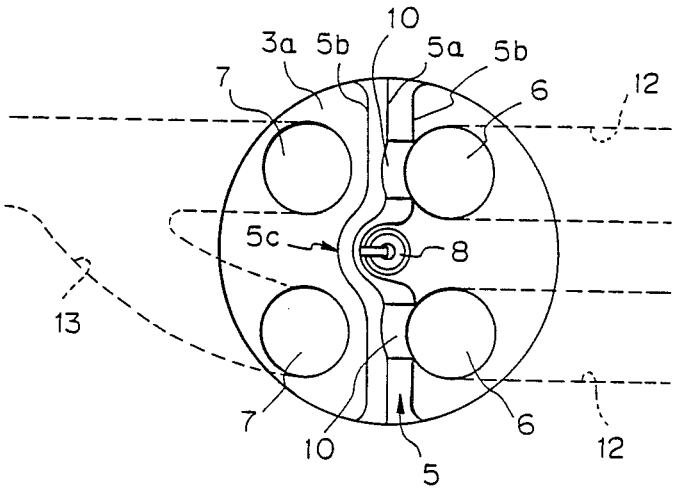
FIG. 2 is a view illustrating the inner wall of the cylinder head.
Figure 3:
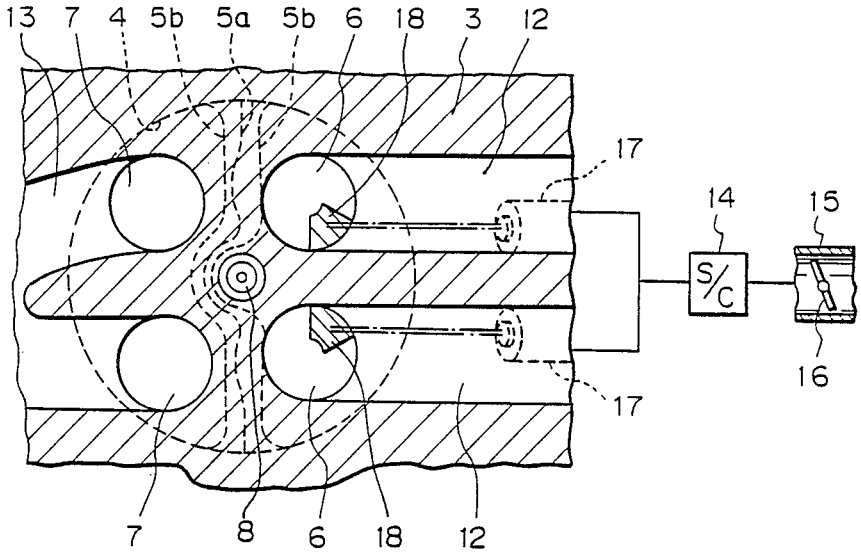
FIG. 3 is a cross-sectional plan view of the cylinder head.

Referring to FIGS. 1 through 3, reference numeral 1 designates a cylinder block, 2 a piston reciprocally movable in the cylinder block 1, 3 a cylinder head fixed onto the cylinder block 1, and 4 a combustion chamber formed between the inner wall 3*a* of the cylinder head 3 and the top face of the piston 2. A raised portion 5 projecting toward the combustion chamber 4 is formed on and extends along the entire length of the diameter of the inner wall 3*a* of the cylinder head 3. As illustrated in FIG. 1, the raised portion 5 has a substantially triangular cross section having a ridge 5*a* at the lower end thereof. The root portions of the raised portion 5 are indicated by reference numerals 5*b* in FIGS. 1 through 3. A pair of intake valves 6 are arranged on one side of the raised portion 5, and a pair of exhaust valves 7 are arranged on the other side of the raised portion 5.

The raised portion 5 has a central portion 5*c* formed as an arc facing the exhaust valves 7, and a spark plug 8 is arranged on the intake valve side of the central arc portion 5*c*. Consequently, the spark plug 8 is located approximately on the cylinder axis on the intake valve side of the raised portion 5. Masking walls 10 are formed on the raised portion 5 for each intake valve 6 to mask the valve opening between the valve seat 9 and the peripheral portion of the intake valve 6, which is located on the exhaust valve side. These masking walls 10 are arranged as close as possible to the peripheral portions of the corresponding intake valves 6 and have an arc-shaped cross-section which extends along the peripheral portion of the corresponding intake valve 6. In addition, these masking walls 10 expand toward the combustion chamber 4 to a position lower than the intake valves 6 which are in the maximum lift position illustrated by the dashed-dotted line in FIG. 1. Consequently, the valve opening between the valve seat and the peripheral portion of the intake valve 6, which is located on the exhaust valve side, is masked by the corresponding masking wall 10 for the entire time for which the intake valve 6 is open. A fixed space exists between the peripheral portions of the exhaust valves 7 and the root portion 5*b* of the raised portion 5, and thus the valve opening between a valve seat 11 and the peripheral portion of the exhaust valve 7, which is located on the intake valve side, is not masked by the raised portion 5. Consequently, when the exhaust valve 7 opens, the valve opening between the valve seat 11 and the exhaust valve 7 is open to the combustion chamber 4 over the entire periphery of the exhaust valve 7.

Intake ports 12 are formed in the cylinder head 3 for the intake valves 6, and an exhaust port 13 is formed in the cylinder head 3 for the exhaust valves 7. The intake ports 12 are connected to the air cleaner (not shown) via, for example, a mechanically driven supercharger 14 driven by the engine and via an intake duct 15, and a throttle valve 16 is arranged in the intake duct 15. Fuel injector 17 are arranged on the upper walls of the intake ports 12, and fuel having a small spread angle is injected in the form of a bar like shape from the fuel injectors 17 toward the hatching areas 18 of the intake valves 6, as illustrated in FIG. 3. These hatching areas 18 are located on the spark plug side of the axes of the intake ports 12 and located on the opposite side of the spark plug 8 with respect to the line passing through the valve stems of both intake valves 6.

Figure 4:
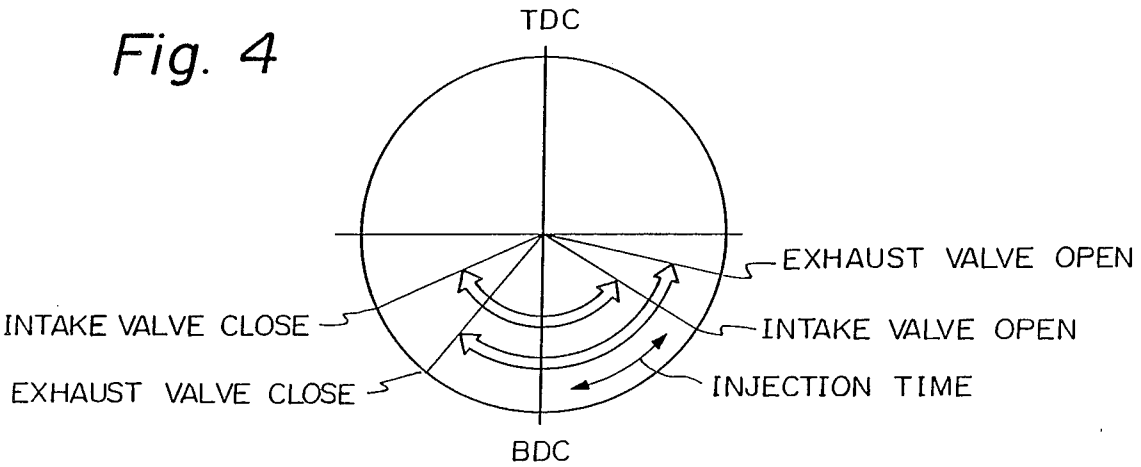
FIG. 4 is a diagram illustrating the opening time of the intake valve and the exhaust valve.

FIG. 4 illustrates an example of the opening time of the intake valves 6 and the exhaust valves 7 and an example of the injection time. In the example illustrated in FIG. 4, the exhaust valves 7 open earlier than the intake valves 6, and the exhaust valves 7 close earlier than the intake valves 6. In addition, the fuel injection time is set to occur at a time after the intake valves 6 open and before the piston 2 reaches bottom dead center BDC.

Figure 5:
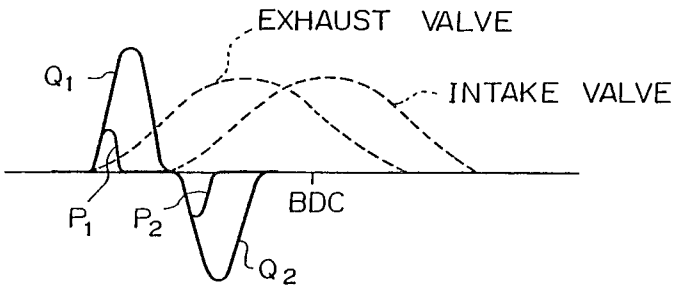
FIG. 5 is a diagram illustrating the valve lift of the intake valve and the exhaust valve and illustrating a change in pressure in the exhaust port.

FIG. 5 illustrates the valve lifts of the intake valves 6 and the exhaust valves 7 and illustrates changes in pressures $P_1$, $P_2$, $Q_1$, $Q_2$ in the exhaust port 13. The changes in pressures $P_1$, $P_2$, $Q_1$, $Q_2$ will be hereinafter described.

Figure 6A:
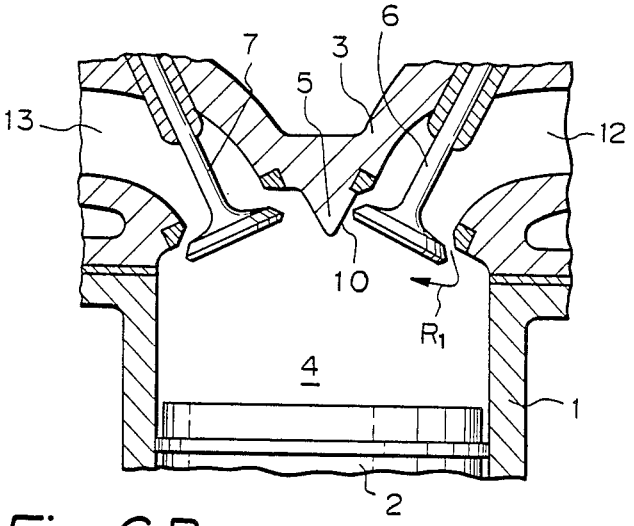
FIGS. 6A and 6B are cross-sectional side views of the engine, illustrating the operation of the engine when under a light load.
Figure 6B:
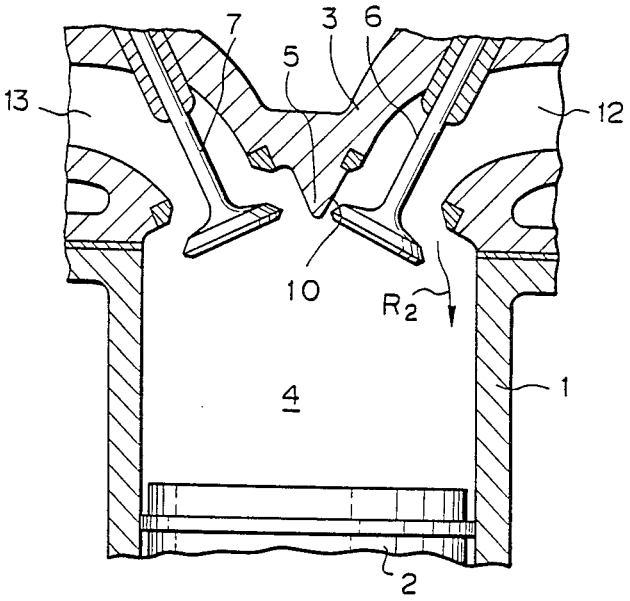
Figure 7A:
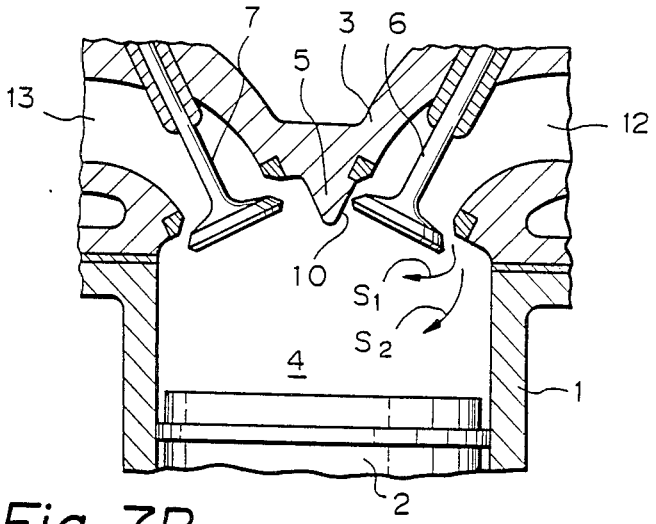
FIGS. 7A and 7B are cross-sectional side views of the engine, illustrating the operation of the engine when under a heavy load.
Figure 7B:
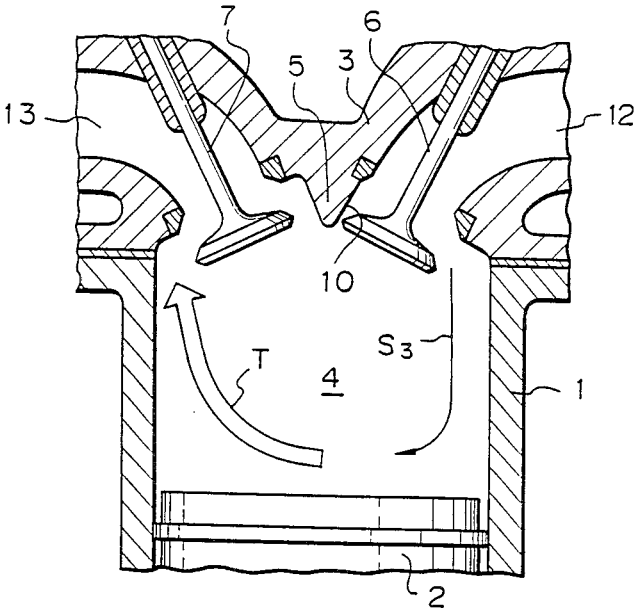

Next, the scavenging operation and the stratifying operation will be described with reference to FIGS. 6 and 7. FIG. 6 illustrates a state where the engine is operating under a light load, and FIG. 7 illustrates a case where the engine is operating under a heavy load. In addition, FIGS. 6(A) and 7(A) illustrate a moment immediately after the intake valves 6 open, and FIGS. 6(B) and 7(B) illustrate a moment when the piston 2 is approximately at bottom dead center BDC.

The scavenging operation and the stratifying operation under a light load operation of the engine will be first described, with reference to FIG. 6.

When the piston 2 moves downward, and the exhaust valves 7 open, burned gas under a high pressure in the combustion chamber 4 flows out into the exhaust port 13, and thus the pressure in the exhaust port 13 becomes temporarily positive, as illustrated by $P_1$ in FIG. 5. This positive pressure $P_1$ propagates in the exhaust passage in the downstream direction thereof and is reflected at the joining portion of the exhaust passages for each cylinder. Subsequently, the thus reflected pressure is again propagated toward the exhaust port 13 in the form of a vacuum pressure. Consequently, when the intake valves 6 open, the vacuum pressure is produced in the exhaust port 13, as illustrated by $P_2$ in FIG. 5. The timing at which the vacuum pressure $P_2$ is produced depends on the length of the exhaust passage. When the engine is operating under a light load, the combustion pressure is low, and thus the positive pressure $P_1$ and the vacuum pressure $P_2$ produced in the exhaust port 13 are relatively small.

When the intake valves 6 open, fresh air containing fuel therein is fed into the combustion chamber 4 from the intake ports 12. At this time, since the masking walls 10 are provided for the valve openings of the intake valves 6, the fresh air and the fuel flow mainly into the combustion chamber 4 from portions of the valve openings of the intake valves 6, which portions are located on the opposite side with respect to the masking walls 10. In addition, when the intake valves 6 open, since the vacuum pressure is produced in the exhaust port 13, as illustrated by $P_2$ in FIG. 5, the burned gas positioned at the upper portion of the combustion chamber 4 is sucked out into the exhaust port 13 due to this vacuum pressure. At this time, as illustrated by the arrow $R_1$ in FIG. 6(A), the fresh air and the fuel is pulled toward the exhaust valves 7 due to the movement of the burned gas, and thus the fuel is introduced into a space around the spark plug 8 (FIG. 2). Then, when the piston 2 moves further downward, as illustrated in FIG. 6(B), the fresh air containing the fuel therein flows downward along the inner wall of the cylinder beneath the intake valves 6, as illustrated by the arrow $R_2$ in FIG. 6(B). But, when the engine is operating under a light load, the amount of fresh air fed into the combustion chamber 4 is small, and in addition, the velocity of the fresh air flowing into the combustion chamber 4 is low. As a result, the fresh air does not reach the top face of the piston 2 but stays at the upper portion of the combustion chamber 4, and consequently, when the piston 2 moves upward, since the air-fuel mixture has collected at the upper portion of the combustion chamber 4, and the residual unburned gas has collected at the lower portion of the combustion chamber 4, the interior of the combustion chamber 4 is stratified, and thus the air-fuel mixture is properly ignited by the spark plug 8.

When the engine is operating under a heavy load, since the combustion pressure becomes high, the positive pressure produced in the exhaust port 13 also becomes high, as illustrated by $Q_1$ in FIG. 5, and in addition, the vacuum pressure produced by the reflection of the positive pressure $Q_1$ becomes great, as illustrated by $Q_2$ in FIG. 5. Furthermore, the peak of the vacuum pressure $Q_2$ occurs a short interval after the production of the positive pressure $P_2$.

When the engine is operating under a heavy load, the amount of fresh air fed into the combustion chamber 4 is large, and the velocity of the fresh air flowing into the combustion chamber 4 becomes high. Consequently, when the intake valves 6 open, a large amount of the fresh air containing the fuel therein flows into the combustion chamber 4 at a high speed. Subsequently, when the burned gas positioned at the upper portion of the combustion chamber 4 is sucked into the exhaust port 13, due to the production of the vacuum pressure $Q_2$ in the exhaust port 13, the direction of flow of the fresh air is changed toward the central portion of the combustion chamber 4 as illustrated by the arrows $S_1$ and $S_2$ in FIG. 7(A). Then, when the piston 2 moves further downward, the fresh air flows downward along the inner wall of the cylinder beneath the intake valves 6 and reaches the top face of the piston 2, as illustrated by $S_3$ in FIG. 7(B). Consequently, the burned gas in the combustion chamber 4 is gradually pushed out by the fresh air and discharged into the exhaust port 13, as illustrated by the arrow T in FIG. 7(B), and thus a loop scavenging operation is realized in the combustion chamber 4.

In a two-stroke engine equipped with the above intake valve and exhaust valve arrangement, the most efficient scavenging effect can be obtained by carrying out such a loop scavenging operation. In addition, in such a two-stroke engine, the amount of residual burned gas is large, and to obtain a good ignition and a subsequent good combustion even if the amount of residual burned gas is large, the air-fuel mixture must collect around the spark plug, i.e., a good stratification is obtained. In the embodiment illustrated in FIGS. 1 through 3, the provision of the masking walls 10 makes it possible to prevent a flow of fresh air and fuel along the inner wall 3*a* of the cylinder head 3 which then flows out into the exhaust port 13, and as a result, a good scavenging operation and a good stratification can be obtained.

In addition, by arranging the spark plug 8 on the intake valve side of the raised portion 5, the air-fuel mixture tends to collect around the spark plug 8, and thus it is possible to obtain a proper ignition of the air-fuel mixture by the spark plug 8. Particularly, the air-fuel mixture tends to stay within an area surrounded by the central arc portion 5*c* of the raised portion 5, and since the spark plug 8 is arranged in this area, the ignition is thus improved. In addition, since the fuel injected from the fuel injectors 17 is instantaneously fed into the combustion chamber 4 after the fuel impinges upon the rear faces of the valve bodies of the intake valves 6, and is atomized, the fuel will not adhere to the inner walls of the intake ports 12.

Figure 8:
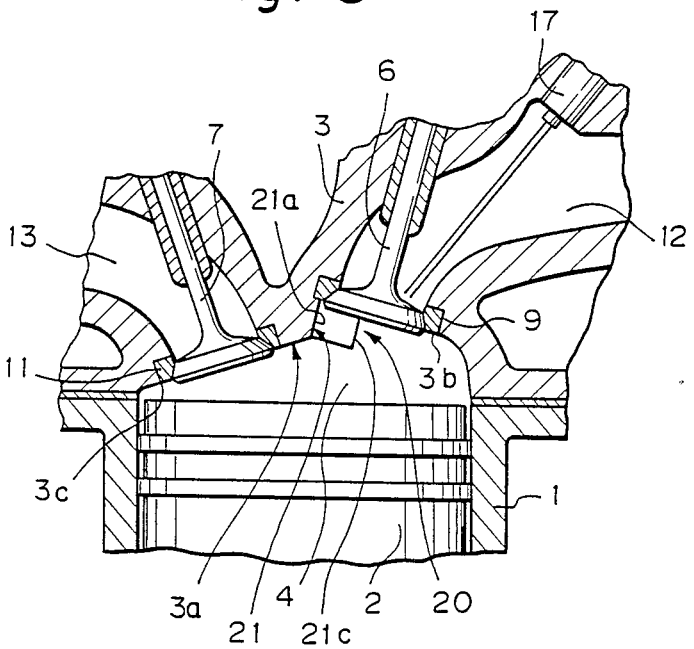
FIG. 8 is a cross-sectional side view of another embodiment of a two-stroke engine.
Figure 9:
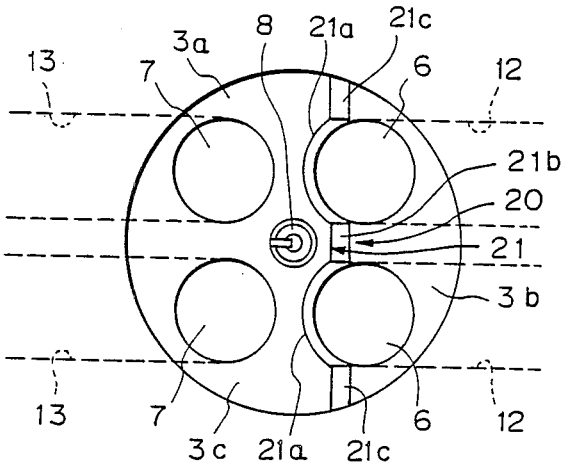
FIG. 9 is a view illustrating the inner wall of the cylinder head of FIG. 8.

FIGS. 8 and 9 illustrate another embodiment of a two-stroke engine, by which an even better loop scavenging operation is obtained. In this embodiment, a depression 20 is formed on the inner wall 3*a* of the cylinder head 3, and the intake valves 6 are arranged on the inner wall portion 3*b* of the cylinder head 3, which forms the bottom wall of the depression 20. The inner wall portion 3*c* of the cylinder head 3 other than the depression 20 is substantially flat, and the exhaust valves 7 are arranged on this inner wall portion 3*c* of the cylinder head 3. The inner wall portions 3*b* and 3*c* of the cylinder head 3 are interconnected via the peripheral wall 21 of the depression 20. The peripheral wall 21 of the depression 20 comprises masking walls 21*a* arranged as close as possible to the peripheral portions of the corresponding intake valves 6 and extending archwise along the periphery of the corresponding intake valves 6, a fresh air guide wall 21*b* arranged between the intake valves 6, and fresh air guide walls 21*c* each arranged between the circumferential wall of the inner wall 3*a* of the cylinder head 3 and the corresponding intake valve 6. The masking walls 21*a* extend toward the combustion chamber 4 to a position lower than the intake valves 6 when the valves 6 are in the maximum lift position, and thus the valve opening between the valve seat 9 and the peripheral portion of the intake valve 6, which is located on the exhaust valve side, is masked by the corresponding masking wall 21*a* for the entire time for which the intake valve 6 is open. The fresh air guide wall 21*b* and the fresh air guide walls 21*c* are located on substantially the same plane and extend substantially in parallel to the line passing through the centers of the intake valves 6. The spark plug 8 is arranged on the inner wall portion 3*c* of the cylinder head 3 in such a manner that it is located at the center of the inner wall 3*a* of the cylinder head 3.

Figure 10:
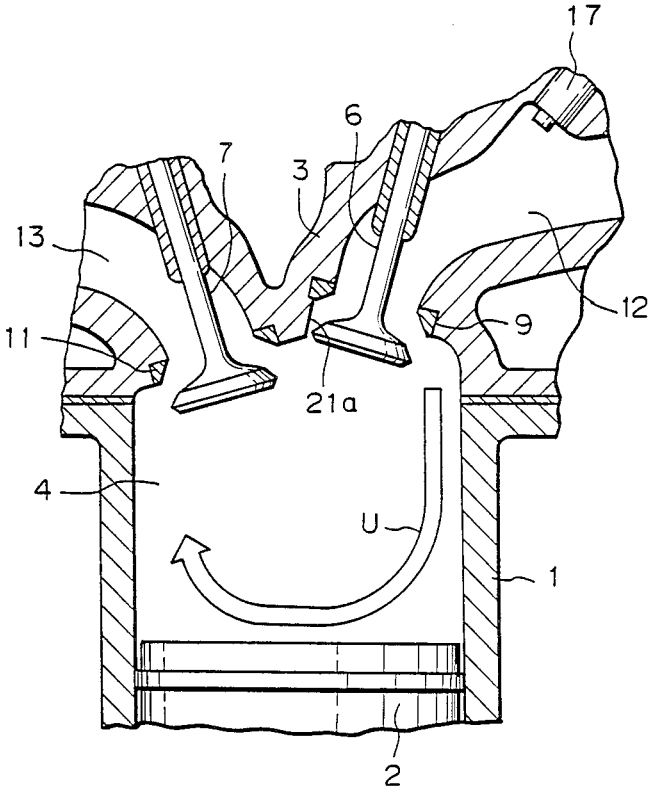
FIG. 10 is a cross-sectional side view of the engine, illustrating the operation of the engine of FIGS. 8 and 9.

In this embodiment, the arced masking walls 21*a* have a peripheral length longer than that of the masking wall 10 illustrated in FIGS. 1 through 3, and thus, at the valve opening between the intake valve 6 and the valve seat 9, one-third of the valve opening, which is located on the exhaust valve side, is masked by the corresponding masking wall 21*a*, and the fresh air is fed from the unmasked two-thirds of the valve opening, which is located at the opposite side of the exhaust valve 7. In addition, in this embodiment, the fresh air flowing into the combustion chamber 4 from the intake valve 6 is guided by the fresh air guide walls 21*b*, 21*c* so as to flow downward along the inner wall of the cylinder. Consequently, in this embodiment, when the intake valves 6 open, a large part of the fresh air flows toward the top face of the piston 2 along the inner wall of the cylinder, as illustrated by the arrow U in FIG. 10, and thus a good loop scavenging operation is carried out.

Figure 11:
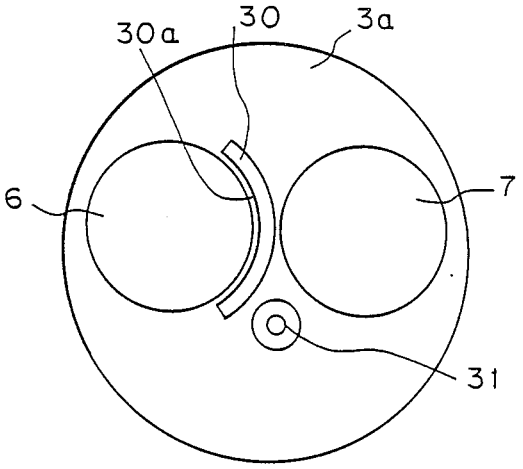
FIG. 11 is a bottom view of the cylinder head of a two-stroke diesel engine.
Figure 12:
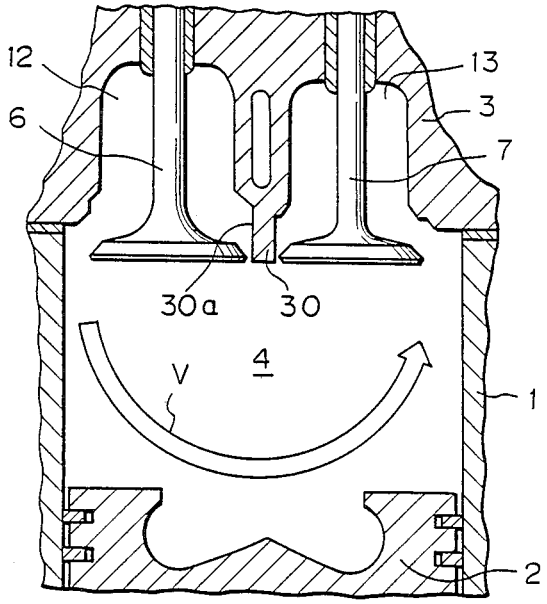
FIG. 12 is a cross-sectional side view of the two-stroke diesel engine.

FIGS. 11 and 12 illustrates the case where the present invention is applied to a two-stroke diesel engine. In this embodiment, a downwardly extending projection 30 is formed on the inner wall 3*a* of the cylinder head 3 between the intake valve 6 and the exhaust valve 7, and a fuel injector 31 is arranged near the projection 30. This projection 30 is provided with a masking wall 30*a* arranged as close as possible to the peripheral portion of the intake valve 6 and extending in an arc along the periphery of the intake valve 6. The masking wall 30*a* extends downward toward the combustion chamber 4 to a position lower than the intake valve 6 when the valve 6 is in the maximum lift position, and thus the valve opening between the valve seat and the peripheral portion of the intake valve 6, which is located on the exhaust valve side, is masked by the masking wall 30*a* for the entire time for which the intake valve 6 is open. Consequently, also in this embodiment, air flows as illustrated by the arrow V in FIG. 12, and thus a good loop scavenging operation is carried out. Where a large projecting amount is necessary for the projection 30, it is possible to prevent the projection 30 from interfering with the piston 2 by arranging the projection 30 so that it faces the cavity of the piston 2.

In the embodiments hereinbefore described, the masking wall is formed on the cylinder head, but the masking wall may be formed on a member which is separate from the cylinder head; for example, the masking wall may be formed on the valve seat for the intake valve or the exhaust valve by suitably modifying the shape of the valve seat.

According to the present invention, by masking the valve opening between the valve seat and the peripheral portion of the intake valve, which is located on the exhaust valve side, for the entire time for which the intake valve is open, by means of the masking wall, it is possible to obtain a good loop scavenging operation, and thus it is possible to obtain a good combustion and a high output power of the engine.

While the invention has been described by reference to specific embodiments chosen for purposes of illustration, it should be apparent that numerous modifications could be made thereto by those skilled in the art without departing from the basic concept and scope of the invention.

We claim:

1. A two-stroke engine comprising:

an engine body including a cylinder head having an inner wall;

a piston reciprocally movable in said engine body, the inner wall of said cylinder head and a top face of said piston defining a combustion chamber therebetween;

at least one intake valve arranged on the inner wall of said cylinder head;

at least one exhaust valve arranged on the inner wall of said cylinder head;

masking means arranged between said intake valve and said exhaust valve to mask a valve opening formed between a valve seat and a peripheral portion of said intake valve, which is located on said exhaust valve side, for the entire time for which said intake valves is open.

2. A two-stroke engine according to claim 1, wherein said masking means has a masking wall arranged close to peripheral portion of said intake valve, which is located on said exhaust valve side, and extending downward toward said piston to a position lower than said intake valve when said intake valve is in the maximum lift position thereof.

3. A two-stroke engine according to claim 2, wherein said masking wall extends in an arc along the peripheral portion of said intake valve.

4. A two-stroke engine according to claim 3, wherein said masking wall extends along approximately one-third of the peripheral portion of said intake valve.

5. A two-stroke engine according to claim 2, wherein the inner wall of said cylinder head has a raised portion projecting downward therefrom toward said piston and extending between said intake valve and said exhaust valve along the inner wall of said cylinder head, and said masking wall is formed on said raised portion.

6. A two-stroke engine according to claim 5, wherein said raised portion has an approximately triangular cross-section.

7. A two-stroke engine according to claim 5, wherein said exhaust valve is spaced from said raised portion.

8. A two-stroke engine according to claim 5, wherein said raised portion extends along the entire length of the diameter of the inner wall of said cylinder head.

9. A two-stroke engine according to claim 8, wherein said engine is provided with two intake valves and said masking wall is provided for each intake valve.

10. A two-stroke engine according to claim 8, further comprising a spark plug arranged on the inner wall of said cylinder head on said intake valve side of said raised portion.

11. A two-stroke engine according to claim 10, wherein said raised portion has an arced central portion facing toward said exhaust valve, and said spark plug is arranged substantially at a center of the inner wall of said cylinder head and surrounded by said central arced portion.

12. A two-stroke engine according to claim 2, wherein said inner wall of said cylinder head has a depression formed thereon and comprises a substantially flat inner wall portion other than said depression, a bottom wall of said depression, and a circumferential wall of said depression, which is located between said inner wall portion and said bottom wall, said intake valve being arranged on said bottom wall, said exhaust valve being arranged on said inner wall portion, said masking wall being formed on said circumferential wall.

13. A two-stroke engine according to claim 12, wherein the circumferential wall of said depression extends between opposed ends of a circumferential wall of the inner wall of said cylinder head, and a portion of said circumferential wall other than said masking wall forms a fresh air guide wall extending downward toward said piston.

14. A two-stroke engine according to claim 13, wherein said engine is provided with two intake valves and said fresh air guide wall comprises a first guide wall located between said intake valves and second guide walls located between the circumferential wall of the inner wall of said cylinder head and said intake valves.

15. A two-stroke engine according to claim 14, wherein said first guide wall and said second guide walls are located in substantially same plane which extends substantially in parallel to a line passing through said intake valves.

16. A two-stroke engine according to claim 12, further comprising a spark plug arranged on said inner wall portion approximately at a center of the inner wall of said cylinder head.

17. A two-stroke engine according to claim 1, wherein said exhaust valve opens earlier than said intake valve and closes earlier than said intake valve.

18. A two-stroke engine according to claim 1, wherein said cylinder head has an intake port formed therein and a fuel injector arranged in said intake port.

19. A two-stroke engine according to claim 18, wherein fuel is injected from said fuel injector toward a portion of a rear face of a valve body of said intake valve, which portion is located on the opposite side of said masking means.

20. A two-stroke engine according to claim 19, wherein said fuel has a bar-like shape having a small spread angle.

21. A two-stroke engine according to claim 18, wherein fuel is injected from said fuel injector after said intake valve opens and before said piston reaches bottom dead center.

22. A two-stroke engine according to claim 1, further comprising a fuel injector arranged on the inner wall of said cylinder head.

* * * * *